US005515151A

United States Patent [19]

Velazquez

[11] Patent Number: 5,515,151

[45] Date of Patent: May 7, 1996

[54] APPARATUS FOR CONTROLLING IMAGE DISTURBING EFFECTS OF A SHEET MOTION OPPOSING FORCE

[75] Inventor: Carlos A. Velazquez, Walworth, N.Y.

[73] Assignee: Xerox Corporation, Stamford, Conn.

[21] Appl. No.: 297,071

[22] Filed: Aug. 29, 1994

[51] Int. Cl.[6] ..... G03G 21/00

[52] U.S. Cl. ..... 355/308; 271/185; 271/188; 271/225; 271/226; 355/282; 355/312

[58] Field of Search ..... 355/282, 285, 355/308, 312; 271/225, 226, 306, 184, 185, 188

[56] References Cited

U.S. PATENT DOCUMENTS

| | | | |
|---|---|---|---|
| 3,190,643 | 6/1965 | Taillie | 355/309 |
| 3,902,645 | 9/1975 | Keck | 226/44 |
| 4,017,065 | 4/1977 | Poehlein | 271/80 |
| 4,058,306 | 11/1977 | Fletcher | 271/80 |
| 4,320,952 | 3/1982 | Seimiya et al. | 355/312 |
| 4,561,581 | 12/1985 | Kelly | 226/113 |
| 4,561,756 | 12/1985 | Lang | 355/315 |
| 4,876,576 | 10/1989 | Itaya et al. | 355/285 |
| 4,905,052 | 2/1990 | Cassand et al. | 355/312 |
| 5,045,892 | 9/1991 | Morisawa et al. | 355/309 |
| 5,063,415 | 11/1991 | Ariyama | 355/312 |
| 5,166,735 | 11/1992 | Malachowski | 355/282 |
| 5,223,903 | 6/1993 | Russel et al. | 355/308 |
| 5,294,965 | 3/1994 | Mary | 355/312 |

*Primary Examiner*—Nestor R. Ramirez
*Attorney, Agent, or Firm*—Tallam I. Nguti

[57] ABSTRACT

A sheet transport apparatus for transporting an image carrying sheet into a fusing apparatus without image disturbances from a sheet motion opposing force. The sheet transport apparatus includes a baffle plate positioned along a line of sheet movement into the fusing apparatus, and active means for moving the image carrying sheet over and towards the baffle plate. The sheet transport apparatus also includes a generally triangular member having a flat base positioned on the baffle plate, and an upstream flank as well as a downstream flank forming an apex thereof for creating a convex buckle in the image carrying sheet prior to the image carrying sheet being subjected to a sheet motion opposing force from contact with the fusing apparatus.

11 Claims, 3 Drawing Sheets

APPARATUS FOR CONTROLLING IMAGE DISTURBING EFFECTS OF A SHEET MOTION OPPOSING FORCE

BACKGROUND OF THE INVENTION

This invention relates generally to an electrostatographic printing machine, and more particularly concerns an apparatus for controlling unfused image disturbing effects of a sheet motion opposing force during a sheet transport.

In an electrostatographic printing machine, a photoconductive member is charged to a substantially uniform potential to sensitize the surface thereof. The charged portion of the photoconductive member is exposed to a light image of an original document being reproduced. Exposure of the charged photoconductive member selectively dissipates the charge thereon in irradiated areas. This records an electrostatic latent image on the photoconductive member corresponding to the informational areas contained within the original document being reproduced. After the electrostatic latent image is recorded on the photoconductive member, the latent image is developed by bringing toner, for example, black toner, into contact therewith. This forms a toner powder image on the photoconductive member which is subsequently transferred to a copy sheet. The copy sheet is then separated from the photoconductive member and the toner powder is fed on the copy sheet through a fusing apparatus where it is heated to permanently affix it to the copy sheet, thus forming a black and white copy of the original document.

Multi-color electrostatographic printing which uses multi-colored toners is substantially identical to the foregoing process of black and white printing using only black toner. However, rather than forming a single latent image on the photoconductive surface, successive single color latent images corresponding to color separated light images of the original document are recorded thereon. Each single color electrostatic latent image is developed with toner particles of a color complimentary thereto. This process is repeated a plurality of cycles for differently colored images using their respective complimentarily colored toner particles to form color toner images. Each single color toner powder image is transferred to a copy sheet in superimposed registration with the other toner powder images. This creates a composite multi-layered toner powder image on the copy sheet. The copy sheet is separated from the photoconductive member and, thereafter, the multi-layered toner powder image on the sheet is fed through a fusing apparatus and permanently affixed to the copy sheet, thus creating a color copy of the original multi-color document.

In a black and white or multi-color electrostatographic printing machine, the copy sheet is typically brought into moving contact with the photoconductive member during toner powder image transfer to the copy sheet. A sheet transport apparatus is typically provided for receiving the copy sheet incrementally as it is incrementally separated from the photoconductive member, and for transporting the copy sheet towards and into the fusing apparatus. A typical fusing apparatus includes a rotatable heated roller and a rotatable back up roller which form a fusing nip for contacting, engaging and frictionally driving the copy sheet with the toner powder image thereon through the fusing nip.

In transporting the copy sheet into the fusing nip, there is a specific kind of toner powder image disturbance or smear that occurs only once, and only at a particular instance. This specific kind of image disturbance or smear is a copy defect that is created at the instance when the lead edge of the copy sheet contacts any part of the fusing apparatus. This is because when the lead edge of the copy sheet contacts the fusing apparatus, an instantaneous backward force is generated by the fusing apparatus in the copy sheet regardless of the speeds of the sheet or the fusing apparatus. This backward force as such is in opposition to the forward motion of the copy sheet. This opposition occurs only during a small, short period of time (t). During such time period (t) motion, the opposing force virtually brings the lead edge to a complete stop, all prior to driving engagement of the lead edge by the fusing nip. As a consequence, the whole sheet also virtually stops instantaneously during such period (t), thus causing slippage of the separating sheet against the photoreceptor, and resulting in the specific image disturbance or smear described above.

The specific kind of instantaneous image disturbance or smear described here is believed to be different from on-going image smear that occurs due to a mismatch between the velocities or speeds of the fusing nip and the photoconductive member. Such on-going image smear is of concern, of course, only after the lead edge of the copy sheet is already in driving engagement within the fusing nip. On the other hand, the specific kind of instantaneous smear or "fuser smear" being addressed by the present invention occurs at the instance of lead edge contact within the fusing apparatus. Such contact as can be appreciated occurs prior to driving engagement of the lead edge by the fusing nip, and, consequently, the "fuser smear" defect would appear to be independent of speed or velocity.

Conventionally, however, "fuser smear" and on-going smear have been treated as being caused by speed or velocity mismatches between the sheet and fusing apparatus. As such, various devices and schemes have been proposed for preventing smearing, by matching the speed or velocity of the fusing nip and that of the sheet being transported thereinto. For example:

U.S. Pat. No. 3,902,645 describes a machine which includes rolls between which a flexible sheet is passed. After passing from one section, the flexible sheet falls downwardly to form a loop, the other side of which passes upwardly into another section of the machine. A motor drives a roll which advances the sheet from one section to the other section. A pivotable plate contacts the lowermost region of the loop. The direction that the plate pivots depends upon the whether the loop is increasing or decreasing. The direction that the plate pivots matches speeds by controlling the speed of the motor advancing the sheet.

U.S. Pat. Nos. 4,017,065 and 4,058,306 disclose a vacuum support interposed between the fuser and the photoreceptor. When the lead edge of the copy sheet enters the fuser roll nip, the vacuum is turned off and a buckle forms in the sheet due to the speed mismatch between the fuser and the photoreceptor.

U.S. Pat. No. 4,561,581 describes a web accumulator positioned between a variable speed drive and an intermittent drive. A portion of a web in the accumulator is curved into a downward extending loop by a curved support and the force of gravity acting on the web.

U.S. Pat. No. 5,294,965 issued Mar. 15, 1994, (Xerox) discloses an oscillating prefuser vacuum sheet transport which has a pivoting downstream end for compensating for a velocity mismatch between a fuser roll and an image receiver. The pivoted end of the transport forms a controlled buckle in an image carrying sheet after the sheet contacts the fuser roll.

U.S. 5,166,735 issued Nov. 24, 1992, discloses a prefuser sheet transport system that includes a buckle sensor and is offset from a linear path to the fuser nip. A signal from the buckle sensor is used to control the speed of the fuser to a matching value.

U.S. Pat. No. 4,905,052 issued May 22, 1990, discloses a copier/printer that has an image transfer station and a fusing station operating at different speeds in order to create a buckle in a sheet. A sensor located therebetween senses the size of the buckle, and at predetermined sizes thereof, adjusts the speeds of the stations.

U.S. Pat. No. 4,905,052 issued Feb. 27, 1990, discloses apparatus for compensating for velocity mismatches between adjacent sheet transports including a first or upstream transport which advances the sheet faster than a second downstream transport. The apparatus further includes a pivotable plate between the adjacent transports that pivots away from the sheet when the sheet contacts the second or downstream transport, thus allowing the sheet to buckle.

U.S. Pat. No. 4,561,756 issued Dec. 31, 1985, discloses a transport system for a short prefuser paper path. Speed mismatch compensation is provided by intentionally driving the fuser roller nip at a mismatching speed to create a downward buckle. The transport system includes a multiple baffle arrangement which allows the downward buckle to form prior to entering the fuser nip. The downward buckle is supposed to absorb speed mismatches thereby preventing image smearing.

SUMMARY OF THE INVENTION

In accordance with one aspect of the present invention, there is provided a reproduction machine including means for forming and transferring a toner image onto an image-side of an image carrying sheet and a fusing apparatus for contacting the image carrying sheet to fuse the toner image thereonto. The reproduction machine also includes a buckling device for preventing the image bearing member from smearing the toner image by creating an image-side convex buckle in the image carrying sheet prior to contact between the image carrying sheet and the fusing apparatus.

In accordance with another aspect of the present invention, there is provided in a reproduction machine including a fusing apparatus and means for forming and transferring a toner image onto an image carrying sheet, a sheet transport apparatus for transporting the image carrying sheet into the fusing apparatus without image disturbances from a sheet motion opposing force. The sheet transport apparatus includes a baffle plate positioned along a line of sheet movement into the fusing apparatus, and active means for moving the image carrying sheet over and towards the baffle plate. The sheet transport apparatus also includes a generally triangular member having a flat base positioned on the baffle plate, and an upstream flank as well as a downstream flank, both forming an apex thereof for creating a convex buckle in the image carrying sheet prior to the image carrying sheet being subjected to a sheet motion opposing force from contact with the fusing apparatus.

Other features of the present invention will become apparent from the following drawings and description.

BRIEF DESCRIPTION OF THE DRAWINGS

Other aspects of the present invention will become apparent as the following description proceeds and upon reference to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
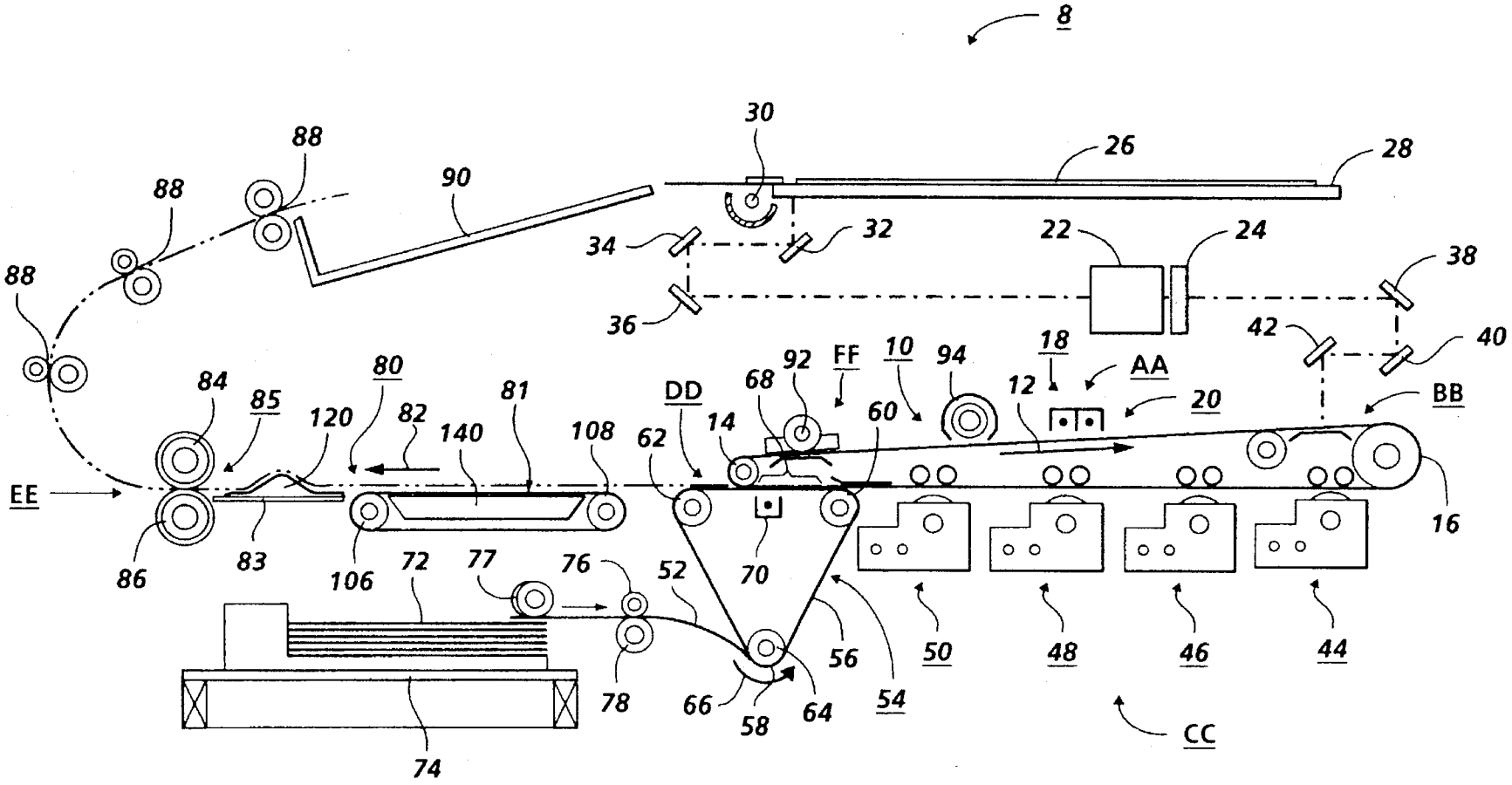
FIG. 1 is a schematic elevational view depicting an electrostatographic printing machine incorporating the sheet transport apparatus of the present invention therein.

For a general understanding of the features of the present invention, reference is made to the drawings. In the drawings, like reference numerals have been used throughout to designate identical elements. FIG. 1 schematically depicts the various components of an illustrative electrostatographic reproduction or printing machine incorporating the sheet transport apparatus of the present invention therein. It will become evident from the following discussion that the apparatus of the present invention is equally well suited for use in a wide variety of printing machines, and is not necessarily limited in its application to the particular electrophotographic printing.

Inasmuch as the art of electrostatographic printing is well known, the various processing stations employed in the FIG. 1 printing machine will be shown hereinafter only schematically and their operation described only briefly with reference thereto.

As shown in FIG. 1, the electrostatographic printing machine 8 employs a photoconductive belt 10. Preferably, the photoconductive belt 10 is made from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated Mylar. The grounding layer is very thin and allows light to pass therethrough. Other suitable photoconductive materials, grounding layers, and anti-curl backing layers may also be employed. As shown, belt 10 is moved in the direction of arrow 12 to advance successive portions of the photoconductive surface sequentially through the various processing stations disposed about the path of movement thereof. Belt 10 is entrained about idler roller 14 and drive roller 16. Idler roller 14 is mounted rotatably so as to rotate with belt 10. Drive roller 16 is rotated by a motor coupled thereto by suitable means such as a belt drive. As roller 16 rotates, it advances belt 10 in the direction of arrow 12.

Initially, a portion of photoconductive belt 10 passes through charging station. At charging station, two corona generating devices, indicated generally by the reference numerals 18 and 20 charge photoconductive belt 10 to a relatively high, substantially uniform potential. Corona generating device 18 places all of the required charge on photoconductive belt 10. Corona generating device 20 acts as a leveling device, and fills in any areas missed by corona generating device 18.

Next, the charged photoconductive surface is rotated to exposure station BB. Exposure station BB includes a moving lens system, generally designated by the reference numeral 22, and a color filter mechanism, shown generally by the reference numeral 24. An original document 26 is supported stationarily upon platen and is illuminated by means of a moving lamp assembly, shown generally by the reference numeral 30. Mirrors 32, 34 and 36 reflect the light rays through lens 22. Lens 22 is adapted to scan successive areas of illumination of platen 28. The light rays from lens 22 are reflected by mirrors 38, 40, and 42 to be focused on the charged portion of photoconductive belt 10. Lamp assembly 30, mirrors 32, 34 and 36, lens 22, are moved with respect to the movement of photoconductive belt 10 to produce a flowing light image of the original document on photoconductive belt 10 in a non-distorted manner. During exposure, filter mechanism 24 interposes selected color filters into the optical light path of lens 22. The color filters operate on the light rays passing through the lens to record an electrostatic latent image, i.e. a latent electrostatic charge pattern, on the photoconductive belt corresponding to a specific color of the flowing light image of the original document.

Subsequent to the recording of the electrostatic latent image on photoconductive belt 10, belt 10 advances the electrostatic latent image to development station CC. Development station CC includes four individual developer units generally indicated by the reference numerals 44, 46, 48 and 50. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer particles are continually moving so as to provide the brush consistently with fresh developer material. Development is achieved by bringing the brush of developer material into contact with the photoconductive surface. Developer units 44, 46, and 48, respectively, apply toner particles of a specific color which corresponds to the compliment of the specific color separated electrostatic latent image recorded on the photoconductive surface.

The color of each of the toner particles is adapted to absorb light within a preselected spectral region of the electromagnetic wave spectrum corresponding to the wave length of light transmitted through the filter. For example, an electrostatic latent image formed by passing the light image through a green filter will record the red and blue portions of the spectrums as areas of relatively high charge density on photoconductive belt 10, while the green light rays will pass through the filter and cause the charge density on the photoconductive belt 10 to be reduced to a voltage level ineffective for development. The charged areas are then made visible by having developer unit 44 apply green absorbing (magenta) toner particles onto the electrostatic latent image recorded on photoconductive belt 10. Similarly, a blue separation is developed by developer unit 46 with blue absorbing (yellow) toner particles, while the red separation is developed by developer unit 48 with red absorbing (cyan) toner particles. Developer unit 50, on the other hand, contains black toner particles and may be used to develop the electrostatic latent image formed from a black and white original document.

Each of the developer units is moved into and out of an operative position. In the operative position, the magnetic brush is closely adjacent the photoconductive belt, while, in a non-operative position, the magnetic brush is spaced therefrom. During development of each electrostatic latent image only one developer unit is in the operative position, the remaining developer units are in the non-operative position. This insures that each electrostatic latent image is developed with toner particles of the appropriate color without co-mingling. In FIG. 1, developer unit 44 is shown in the operative position with developer units 46, 48 and 50 being in the nonoperative position.

After development, the toner image is moved to transfer or detack station DD where the toner image is transferred to a copy sheet 52, such as plain paper amongst others. At transfer station DD, a transfer conveyor, indicated generally by the reference numeral 54, moves copy sheet 52 into contact with photoconductive belt 10. Photoconductive belt 10, for example, is being moved at a velocity of about 7.5 inches per second in the direction of arrow 12. Transfer conveyor 54 has a pair of spaced belts 56 entrained about three rolls 58, 60 and 62. A gripper 64 extends between belts 56 and moves in unison therewith. Sheet 52 is advanced from a stack of sheets 72 disposed in tray 74. Feed roll 77 advances the uppermost sheet from stack 72 into the nip defined by forwarding rollers 76 and 78. Forwarding rollers 76 and 78 advance sheet 52 to transfer conveyor 54. Sheet 52 is advanced by forwarding rollers 76 and 78 in synchronism with the movement of gripper 64. In this way, the leading edge of sheet 52 arrives at a preselected position to be received by the open gripper 64. The gripper then closes securing the sheet thereto for movement therewith in a recirculating path. The leading edge of the sheet is secured releasably by gripper 64. As the belts move in the direction of arrow 66, sheet 52 moves into contact with the photoconductive belt, at a transfer zone 68 in synchronism with the toner powder image developed thereon. Transfer conveyor 54 advances sheet 52 at about 7.5 inches per second. A corona generating device 70 sprays ions onto the backside of the sheet so as to charge the sheet to the proper magnitude and polarity for attracting the toner powder image from photoconductive belt 10 thereto.

Sheet 52 remains secured to gripper 64 so as to move in a recirculating path for three cycles. In this way, three different color toner powder images are transferred to sheet 52 in superimposed registration with one another. Thus, the aforementioned steps of charging the photoconductive surface, exposing the photoconductive surface to a specific color of the flowing light image of the original document, developing the electrostatic latent image recorded on the photoconductive surface with appropriately colored toner, and transferring the toner images to the sheet of support material are repeated a plurality of cycles to form a multicolor copy of a colored original document. During transfer of the toner powder images to sheet 52, sheet 52 is electrostatically tacked to photoconductive belt 10 and moves therewith. After the last transfer operation, the lead edge of sheet 52 is stripped from photoconductive belt as it approaches roller 14. Thereafter, grippers 64 open and release sheet 52.

In accordance with the present invention, a sheet transport, indicated generally by the reference numeral 80, then acquires the lead edge of sheet 52. Sheet transport 80 is mounted preferably in a substantially horizontal orientation, and includes a driven belt, and a vacuum transport section 81 so that the sheet is secured releasably to the belts of the transport by the vacuum applied thereon. Sheet transport 80 transports sheet 52, in the direction of arrow 82. The surface of sheet 52 opposed from the surface having the toner powder images transferred thereto is in contact with the belts of transport section 81. Thus, the unfused toner powder images on the image-side of sheet 52 remain undisturbed. The sheet transport apparatus 80 also includes a baffle plate 83 that is positioned along a line of sheet movement into fusing apparatus 85 at fusing station EE, and guides the lead edge of sheet 52 into the fusing nip defined by fuser roller 84 and pressure roll 86 for fusing. Sheet transport 80 as such thus can secure and move the sheet 52 with a steady forward motion force towards the fuser 85.

Figure 2:
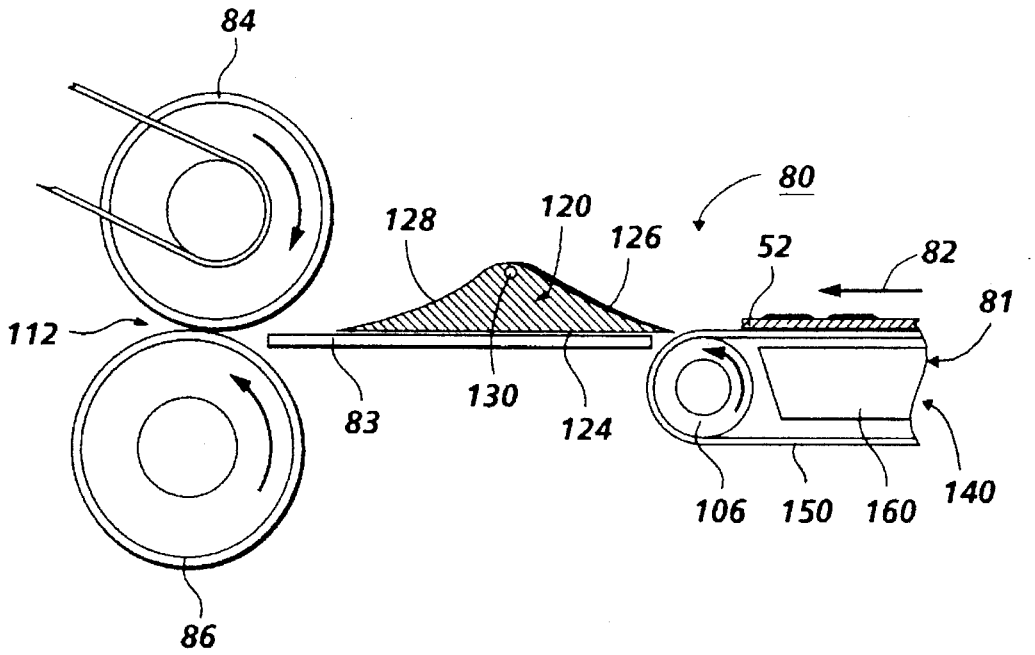
FIGS. 2 to 5 are schematic elevational views of the sheet transport of FIG. 1 depicting the structure and operation of the buckling device of the present invention.
Figure 3:
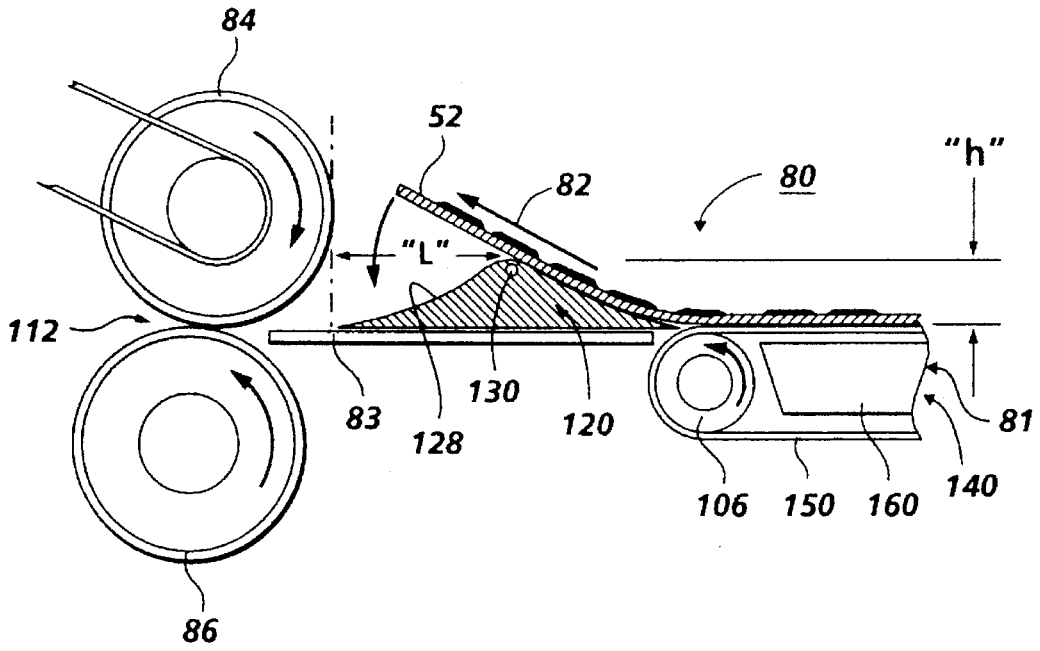
Figure 4:
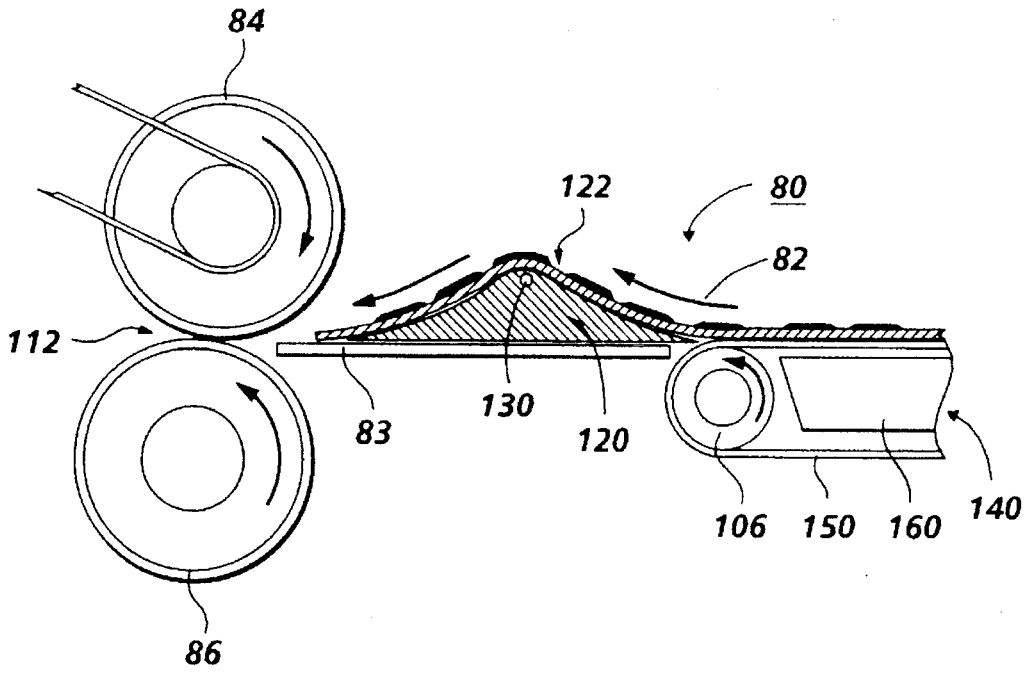
Figure 5:
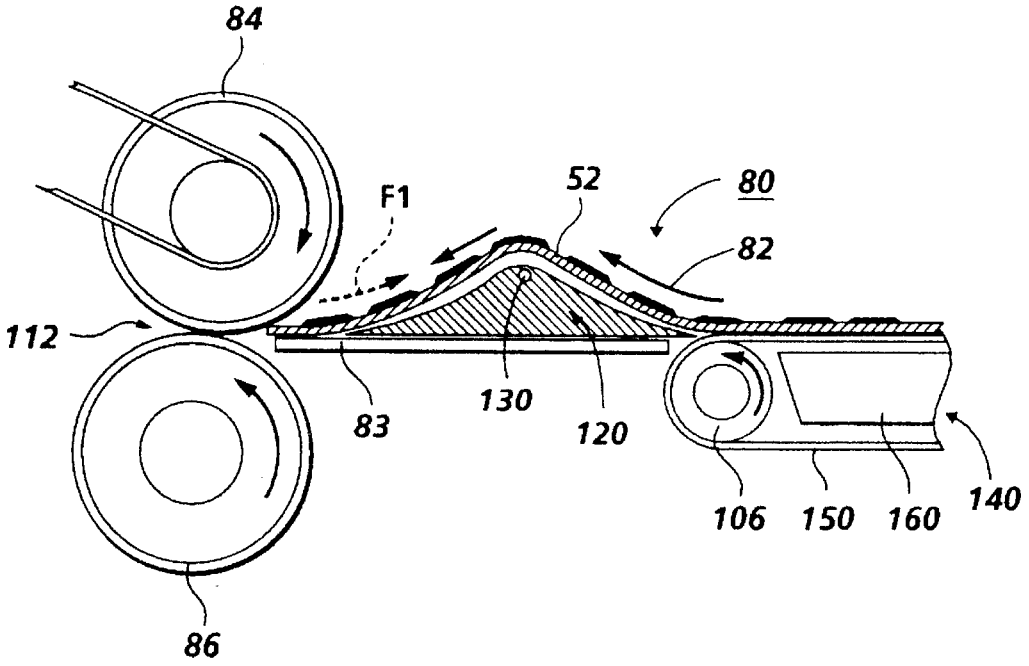

Referring now to FIGS. 2 to 4, the sheet transport 80 importantly includes a buckling device 120 for preventing image bearing member or photoconductive belt 10 from smearing the unfused toner powder image on the sheet 52, at the moment of contact between the sheet and the fusing apparatus. The buckling device does so by creating an image-side convex buckle 122 in the image carrying sheet 52 prior to such sheet making contact with the fusing apparatus 85. As shown, buckling device 120 preferably is a generally triangular member having a flat base 124 positioned on the baffle plate 83. The buckling device 120 as shown thus includes an upstream flank 126 as well as a downstream flank 128 that together form an apex 130 thereof. The apex 130 is preferably located at a predetermined distance "L" upstream (relative to movement of the sheet 52) from the fusing apparatus. The lead edge of sheet 52 thus can be moved up the upstream flank 126 (FIG. 3) so as to project beyond the apex 130 without making contact with the fusing apparatus 85, and until the force of gravity pulls such lead edge and projecting section of the sheet 52 downwards into contact with the downstream flank 128. Depending on the bond weight of the sheet 52, the distance "L" which is required to cause the projecting section of the sheet to drop gravitationally onto the downstream flank as such, preferably is within a range of 35 mm for lighter weight sheets, and 65 mm for heavier sheets. The height "h" of the apex 130 is preferably within a range of 0.5–2.0 mm at such a distance "L" from the fusing apparatus 85 in order to provide a significant initial convex buckle over the apex. As such, the buckling device 120 can effectively create the convex buckle 122 in the image carrying sheet 52 prior to the image carrying sheet being subjected to a sheet motion opposing force (FIG. 5) from contact with the fusing apparatus 85.

The transport apparatus 80 also includes a substantially horizontal sheet active transport assembly 140 which for example includes driven belts 150 and vacuum means 160 for securing and moving the image carrying sheet 52 with a steady forward motion force onto the buckling device 120. The buckling device 120 is mounted downstream of the transport assembly 140.

The purpose of the transport apparatus of the present invention is to prevent instantaneous toner smear occurring on the sheet 52 within a nip formed by the sheet 52 and the photoreceptor 10 as the sheet is being separated therefrom. The buckling device 120 operates to create an anti-gravity buckle prior to the lead edge of the sheet 52 making contact with the fusing apparatus 85. As such, the anti-gravity buckle acts to prevent the entire section of the sheet between the contacting fusing apparatus and the image transfer nip from transmitting the effects of the sheet motion opposing force from the fusing apparatus back to into the nip between the sheet and the photoreceptor.

Without the buckle 122 to absolve both the forward feeding force effect of the transport assembly 140, and the motion opposing effect of lead edge contact of the sheet with fusing apparatus 85, the sheet 52 will be forced to reduce its velocity for an instant. An unbuckled sheet, or a concave buckle sheet ordinarily will completely transmit the net effects of the opposing force. This is because ordinary gravitational pull downwards on the sheet section forming the concave buckle would cause the buckling section to bottom out, thus leaving little or no room for additional buckling to absolve the simultaneous effects of sheet feeding and opposing forces. Such transmission of the net effects of an opposing force will thus compress the sheet 52 against the electrostatic force ordinarily holding it onto the photoconductive surface of belt 10 (FIG. 1), therefore resulting in the undesirable instantaneous smear.

With continued reference to FIG. 1, as the sheet 52 continues to advance through the fusing nip, the buckle in the sheet is slowly eliminated and the trailing portion of the sheet is dragged off the sheet transport 80. After sheet 52 exits the fusing nip defined by fuser roller 84 and pressure roller 86, sheet 52 is advanced by a series of forwarding roll pairs 88 to catch tray 90 for subsequent removal therefrom by a machine operator. While the buckle 122 and trail edge of the copy sheet are being created by the sheet transport 80, the rest of the printing machine 10 continues to process the next copy. Inasmuch as a full color copy takes three passes, there is sufficient time to remove the copy before the next copy makes the transition to sheet transport 80. Further details of the foregoing are shown in FIGS. 2 to 5.

The last processing station in the direction of movement of belt 10, as indicated by arrow 12 is cleaning station FF. A rotatably mounted fibrous brush 92 is positioned in cleaning station FF and maintained in contact with photoconductive belt 10 to remove residual toner particles remaining after the transfer operation. Thereafter, lamp 94 illuminates photoconductive belt 10 in order to remove any residual charge remaining thereon prior to the start of the next successive cycle.

Referring to FIGS. 2 to 5, there is shown the fusing apparatus 85 and part of the sheet transport 80 advancing an image carrying sheet 52 from photoconductive belt 10 towards the fusing apparatus 85. Sheet transport 80 includes a plurality of driven belts 150 entrained about rollers 106 and 108. Roller 106 is spaced from roller 108. A vacuum plenum 160 is positioned interiorly of belts 150 so as to reduce the pressure at the surface thereof to vacuum tack sheet 52 thereon. Roller 106 is driven by a motor (not shown) to move belts 150 in the direction of arrow 82. In this way, sheet 52, secured by the vacuum releasably on belts 150 is moved in unison therewith in the direction of arrow 82. As the lead edge of sheet 52 advances towards the fusing apparatus. 85, it is guided by the buckling device 120 and plate 83 into the nip 112 defined by fuser roller 84 and pressure roller 86. First, the lead edge of the sheet 52 makes contact within the nip 112. The fuser roller 84 and pressure roller 86 then cooperate with one another to engage the lead edge and thereafter frictionally advance sheet 52 through nip 112. It is noted that during such engagement and frictional driving, mismatches between the speeds of the fusing rollers and of the sheet 52, would ordinarily result in ongoing image smearing, particularly where the sheet is longer than the distance between the detack station and the fusing nip 112.

In recapitulation, a reproduction machine has been provided and includes a movable image bearing member, means for forming a toner image on the movable image bearing member, and means for supplying an image carrying sheet into contact with the movable image bearing member to receive the toner image thereon. The reproduction also includes detack means for separating the image carrying sheet and the toner image from the movable image bearing member, and a fusing apparatus forming a fusing nip for contactably receiving and fusing the toner image onto the image carrying sheet. The fusing apparatus is positioned downstream of the detack means relative to movement of the separated image carrying sheet. More importantly, the reproduction machine includes buckling means for preventing an instantaneous smear of a portion of the toner image by the detack means when the image carrying sheet initially contacts the fusing apparatus. The buckling means is positioned between the fusing nip and the detack means for creating a convex, image-side buckle in the image carrying sheet prior to the image carrying sheet making contact with the fusing apparatus.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A reproduction machine comprising:

(a) means for forming and transferring a toner image onto an image-side of an image carrying sheet;

(b) a fusing apparatus for contacting the image carrying sheet to fuse the toner image thereonto; and (c) a generally triangular buckling device for preventing smearing of the toner image on the image carrying sheet by gravitationally creating an image-side convex buckle in the image carrying sheet prior to contact between the image carrying sheet and said fusing apparatus, said generally triangular buckling device including a downstream declining flank for gravitationally supporting the image carrying sheet into contact with said fusing apparatus.

2. The reproduction machine of claim 1, including a separate substantially horizontal sheet transport assembly for transporting the image carrying sheet onto said buckling device.

3. The reproduction machine of claim 2, wherein said buckling device is mounted downstream of said separate sheet transport assembly relative to movement of the sheet for creating the image-side convex buckle over said sheet transport assembly.

4. The reproduction machine of claim 2 wherein said sheet transport assembly comprises a moving belt and vacuum means for holding and moving the image carrying sheet with a steady forward motion force.

5. The reproduction machine of claim 1, wherein said fusing apparatus comprises a pair of rotatable rollers forming a fusing nip for receiving and driving the image copy sheet therethrough.

6. The reproduction machine of claim 1, wherein said generally triangular member includes a flat base positioned along a line of sheet movement through said fusing apparatus, and an apex thereof located a distance within a range of 35 mm to 65 mm upstream of said fusing apparatus, relative to sheet movement so as to allow a sufficiently upwardly projecting section of the lead edge of the image carrying sheet to gravitationally drop onto said downstream declining flank just before contact with said fusing apparatus.

7. The reproduction machine of claim 6, wherein said apex of said generally triangular buckling device has a height a range of 0.5 mm to 2.0 mm so as to provide a significant buckle.

8. In a reproduction machine including a fusing apparatus and means for forming and transferring a toner image onto an image carrying sheet, a sheet transport apparatus for transporting the image carrying sheet into the fusing apparatus without image disturbances from a sheet motion opposing force, the sheet transport apparatus comprising:

(a) a baffle plate positioned along a line of sheet movement into the fusing apparatus;

(b) belt and vacuum active means for moving the image carrying sheet towards said baffle plate; and (c) a separate and generally triangular member having a flat base positioned on said baffle plate, and having an upstream flank and a downstream flank both forming an apex thereof for gravitationally creating a convex buckle in the image carrying sheet prior to the image carrying sheet being subjected to a sheet motion opposing force from contact with the fusing apparatus.

9. The sheet transport apparatus of claim 8, wherein said baffle plate is positioned downstream of said belt and vacuum means and in a generally horizontal orientation along a line of sheet movement into the fusing apparatus.

10. The sheet transport apparatus of claim 8, wherein said apex thereof is located within a distance of 35 mm to 65 mm from the fusing apparatus.

11. The sheet transport apparatus of claim 8, wherein said apex of said generally triangular member has a height of about 2 mm above said flat base.

* * * * *